US006286585B1

(12) United States Patent
Twardowska et al.

(10) Patent No.: US 6,286,585 B1
(45) Date of Patent: Sep. 11, 2001

(54) SLEEVE MIXES CONTAINING STABILIZED MICROSPHERES AND THEIR USE IN MAKING RISER SLEEVES

(75) Inventors: Helena Twardowska; Ronald C. Aufderheide, both of Dublin, OH (US)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 09/532,682

(22) Filed: Mar. 21, 2000

(51) Int. Cl.[7] ..... C08J 9/32; B22C 1/22

(52) U.S. Cl. ..... 164/527; 164/529; 164/359; 521/54; 523/218; 523/219

(58) Field of Search ..... 521/54; 523/218, 523/219; 164/527, 529, 359

(56) References Cited

U.S. PATENT DOCUMENTS

| | | | | |
|---|---|---|---|---|
| 3,409,579 | | 11/1968 | Robins | 260/30.4 |
| 4,240,496 | | 12/1980 | El Gammal | 164/138 |
| 4,352,856 | | 10/1982 | Smillie | 428/329 |
| 5,411,763 | * | 5/1995 | Weaver et al. | 427/249 |
| 5,915,450 | * | 6/1999 | Aufderheide et al. | 64/53 |
| 6,133,340 | * | 10/2000 | Menon | 523/139 |

FOREIGN PATENT DOCUMENTS

| | | | |
|---|---|---|---|
| WO 97/35677 | 10/1997 | (WO) | B22C/9/08 |
| WO 98/03284 | 1/1998 | (WO) | B22D/7/10 |

* cited by examiner

*Primary Examiner*—Morton Foelak
(74) *Attorney, Agent, or Firm*—David L. Hedden

(57) ABSTRACT

This invention relates to exothermic and insulating sleeve mixes comprising (1) a sleeve composition comprising stabilized hollow aluminosilicate microspheres, and (2) a chemically reactive binder. Sleeves are formed from the sleeve mix and are cured in the presence of a catalyst by the cold-box or no-bake curing process. The invention also relates to a process for casting metal parts using a casting assembly where the sleeves are a component of the casting assembly. Additionally, the invention relates to the metal parts produced by the casting process.

9 Claims, No Drawings

SLEEVE MIXES CONTAINING STABILIZED MICROSPHERES AND THEIR USE IN MAKING RISER SLEEVES

FIELD OF THE INVENTION

This invention relates to exothermic and insulating sleeve mixes comprising (1) a sleeve composition comprising stabilized hollow aluminosilicate microspheres, and (2) a chemically reactive binder. Sleeves are formed from the sleeve mix and are cured in the presence of a catalyst by the cold-box or no-bake curing process. The invention also relates to a process for casting metal parts using a casting assembly where the sleeves are a component of the casting assembly. Additionally, the invention relates to the metal parts produced by the casting process.

BACKGROUND OF THE INVENTION

A casting assembly consists of a pouring cup, a gating system (including downsprues, choke, and runner), risers, sleeves, molds, cores, and other components. To produce a metal casting, metal is poured into the pouring cup of the casting assembly and passes through the gating system to the mold and/or core assembly where it cools and solidifies. The metal part is then removed by separating it from the core and/or mold assembly.

Risers or feeders are reservoirs which contain excess molten metal which is needed to compensate for contractions or voids of metal which occur during the casting process. Metal from the riser fills such voids in the casting when metal from the casting contracts. Thus, the metal from the riser is allowed to remain in a liquid state for a longer period, thereby providing metal to the casting as it cools and solidifies. Sleeves are used to surround or encapsulate the riser and other parts of the casting assembly in order to keep the molten metal in the riser hot and maintain it in the liquid state. The temperature of the molten metal and the amount of time that the metal in the riser remains molten are a function of the sleeve composition and the thickness of the sleeve wall, among other factors.

Typical materials used to make sleeves are aluminum, oxidizing agents, fibers, fillers and refractory materials, particularly alumina, aluminosilicate, and aluminosilicate in the form of hollow aluminosilicate spheres. The type and amount of materials in the sleeve mix depends upon the properties of the sleeves that are to be made, particularly the insulating and exothermic properties of the sleeve.

Three basic processes are used for the production of sleeves, "ramming", "vacuuming", and "blowing or shooting". Ramming and blowing are methods of compacting a sleeve composition and binder into a sleeve shape. Ramming consists of packing a sleeve mix (sleeve composition and binder) into a sleeve pattern made of wood, plastic, and/or metal. Vacuuming consists of applying a vacuum to an aqueous slurry of a refractory and/or fibers and suctioning off excess water to form a sleeve. Typically, when vacuuming is used to form the sleeve, the sleeves formed are oven-dried to remove contained water and cure the sleeve. If the contained water is not removed, it may vaporize when it is exposed to the hot metal and result in a safety hazard.

These compositions are modified, in some cases, by the partial or complete replacement of the fibers with hollow aluminosilicate microspheres. See PCT publication WO 94/23865. This procedure makes it possible to vary the insulating and exothermic properties of the sleeves and reduces or eliminates the use of fibers which can create health and safety problems to workers making the sleeves and using the sleeves in the casting process. WO 98/03284 discloses a cold-box and no-bake process for making sleeves with certain hollow aluminosilicate microspheres. The hollow aluminosilicate microspheres disclosed in these patent applications are of two basic types. One type is high in alumina (at least 38 weight percent based upon the weight of the microspheres) and contains small amounts of alkaline impurities. The other type is low in alumina (less than 38 weight percent alumina based upon the weight of the microspheres), high in silica, and contains a higher amount of alkaline impurities, such as Na, K, Ca, Mg. The low alumina hollow microspheres release alkaline materials when they are heated to high temperatures of about 700° C. and higher. These resulting alkaline materials are not desirable by-products. These decomposition products contaminate the sand and the sand is less effectively bonded when used again to make molds and cores for use in the casting assembly.

SUMMARY OF THE INVENTION

This invention relates to exothermic and insulating sleeve mixes comprising:

(1) a sleeve composition comprising pH or thermally stabilized hollow aluminosilicate microspheres having an aluminosilicate content of less than 38 weight percent based upon the weight of the microspheres, and (2) a chemically reactive binder.

The sleeve mixes are used to prepare exothermic and insulating sleeves. The sleeves are cured in the presence of a catalyst by the cold-box or no-bake curing process. The invention also relates to a process for casting metal parts using a casting assembly where the sleeves are a component of the casting assembly.

The major advantage of using these sleeve mixes is that sleeves made from the sleeve mixes do not produce alkaline impurities, such as Na, K, Ca, and Mg cations, during the casting of metal. This is not the case when sleeve mixes prepared with aluminosilicate microspheres that are not pH stabilized are used. These sleeve mixes produce such alkaline impurities. The alkaline impurities may come into contact and mix with the sand used in the molds and cores of the casting assembly. As a result, the sand cannot be easily reclaimed or reused. Since sand reclamation is an important economic and environmental concern, there is an interest in using sleeves that will not generate alkaline impurities.

Additionally, changes in pH affect the ability of a binder to hold sand together, resulting in a loss of strength and increased casting defects.

DEFINITIONS

The following definitions will be used for terms in the disclosure and claims:

Casting assembly—assembly of casting components such as pouring cup, downsprue, gating system (downsprue, runner, choke), molds, cores, risers, sleeves, etc. which are used to make a metal casting by pouring molten metal into the casting assembly where it flows to the mold assembly and cools to form a metal part.

Chemical binding—binding created by the chemical reaction of a catalyst and a binder which is mixed with a sleeve composition.

Cold-box—mold or core making process, which uses a vaporous catalyst to cure resins, used to make the mold or core.

ISOCURE® cold-box binder—a two part polyurethane-forming cold-box binder where the Part I is a phenolic resin similar to that described in U.S. Pat. No. 3,485,797. The resin is dissolved in a blend of aromatic, ester, and aliphatic solvents, and a silane. Part II is the polyisocyanate component, and comprises a polymethylene polyphenyl isocyanate, a solvent blend consisting primarily of aromatic solvents and a minor amount of aliphatic solvents, and a benchlife extender. The weight ratio of Part I to Part II is about 55:45.

Insulating sleeve—a sleeve having greater insulating properties than the mold/core assembly into which it is inserted. An insulating sleeve typically contains low-density materials such as fibers and/or hollow microspheres.

Mold assembly—an assembly of molds and/or cores made from a foundry aggregate (typically sand) and a foundry binder, which is placed in a casting assembly to provide a shape for the casting.

No-bake—mold or core making process which uses a liquid catalyst to cure the mold or core, also known as cold-curing.

Riser—cavity connected to a mold or casting cavity of the casting assembly, which acts as a reservoir for excess molten metal to prevent cavities in the casting as it contracts on solidification. Risers may be open or blind. Risers are also known as feeders or heads.

Safety margin—distance from the top of the casting surface to the shrinkage cavity within the riser. A positive value indicates that all shrinkage was confined to the riser and the casting was sound. A negative value indicates that shrinkage extended into the casting. The safety margin can be measured in inches or as a percentage of the total height of the original riser. Generally, values that are more positive indicate better performance.

SG—hollow aluminosilicate microspheres sold by PQ Corporation having a particle size of 10–350 microns and an alumina content between 28% to 33% by weight based upon the weight of the microspheres.

SLG—hollow aluminosilicate microspheres sold by PQ Corporation having a particle size of 10–300 microns and an alumina content of at least 40% by weight based upon the weight of the microspheres.

Sleeve—any moldable shape having exothermic and/or insulating properties made from a sleeve composition which covers, in whole or part, any component of the casting assembly such as the riser, runners, pouring cup, sprue, etc. or is used as part of the casting assembly. Sleeves can have a variety of shapes, e.g. cylinders, domes, cups, boards, cores.

Sleeve composition—any composition that is capable of providing a sleeve with exothermic and/or insulating properties.

Sleeve mix—a mixture comprising a sleeve composition and a chemical binder.

BEST MODE AND OTHER MODES FOR PRACTICING THE INVENTION

The sleeve mixes used in the subject process contain (1) a sleeve composition comprising stabilized hollow aluminosilicate microspheres and (2) an effective amount of chemically reactive binder. The sleeve mix is shaped and cured by contacting the sleeve mix with an effective amount of a curing catalyst.

The novel aspect of the invention is the use of pH or thermally stabilized hollow aluminosilicate microspheres having an alumina content of less than 38 weight percent alumina based upon the weight of the microspheres. Stabilized hollow microspheres reduce, or preferably eliminate cations that interfere with sand reclamation. The stabilized hollow aluminosilicate microspheres have a pH of about 5.5 to 8.0, preferably about 6.0 to 7.5. The pH of the stabilized microspheres is stable even at increase temperatures, e.g. 700° C. The stabilized hollow aluminosilicate microspheres are created by the treatment of hollow aluminosilicate microspheres having an alumina content of less than about 38 weight percent[1], based upon the weight of the microspheres, with a small amount of an inorganic acid or inorganic acidic salt during processing. The treatment can be the result of the process used to create and collect the hollow microspheres or it can be a secondary process of neutralizing the microspheres before they are used. Particularly preferred as the acid are hydrochloric acid and sulfuric acid. An example of such stabilized hollow aluminosilicate microspheres is GT hollow aluminosilicate microspheres sold by PQ Corporation having a pH of about 8.3.

[1] See for example WO 98/03284, which are hereby incorporated by reference.

The amount of stabilized hollow aluminum silicate microspheres in the sleeve composition can vary from 25 to 100 weight percent based upon the weight percent of the sleeve composition. Typically the amount of stabilized hollow aluminum silicate microspheres used in exothermic sleeve compositions is from 50 to 100 weight percent based upon the weight percent of the sleeve composition, preferably from 60 to 80 weight percent. Typically, the amount of stabilized hollow aluminum silicate microspheres used in insulating sleeve compositions is up to 100 weight percent based upon the weight percent of the sleeve composition, preferably from 35 to 100 weight percent.

The sleeve composition can also contain other exothermic and/or insulating materials. Exothermic materials include oxidizable metals and an oxidizing agent capable of generating an exothermic reaction at the temperature where the metal can be poured.

The oxidizable metal typically is aluminum, although magnesium and similar metals can also be used. When aluminum metal is used as the oxidizable metal for the exothermic sleeve, it is typically used in the form of aluminum powder and/or aluminum granules. The oxidizing agent used for the exothermic sleeve includes iron oxide, manganese oxide, nitrate, potassium permanganate, etc. Typically the weight ratio of aluminum to oxidizing agent is from about 10:1 to about 2:1, preferably about 5:1 to about 4:1.

The thermal properties of the exothermic sleeve are enhanced by the heat generated from the exothermic material, which reduces the temperature loss of the molten metal in the riser, thereby keeping it hotter and liquid longer. The exotherm results from the reaction of aluminum metal, which has a thermal conductivity greater than 150 W/m.K at room temperature, more typically greater than 200 W/m.K. A mold and/or core does not exhibit exothermic properties.

Insulating materials typically used are hollow aluminosilicate microspheres that are not stabilized. The thermal conductivity of the hollow aluminosilicate microspheres ranges from about 0.05 W/m.K to about 0.6 W/m.K at room temperature, more typically from about 0.1 W/m.K to about 0.5 W/m.K.

The insulating and exothermic properties of the sleeve can be varied, but have thermal properties which are different in degree and/or kind than the mold assembly into which they will be inserted.

Depending upon the degree of exothermic properties wanted in the sleeve, the amount of aluminum in the sleeve will range from 0 weight percent to 50 weight percent, typically 5 weight percent to 40 weight percent, based upon the weight of the sleeve composition.

Depending upon the degree of insulating properties wanted in the sleeve, the amount of hollow aluminosilicate microspheres, in the sleeve will range from 0 weight percent to 100 weight percent, typically 35 weight percent to 100 weight percent, based upon the weight of the sleeve composition. Since in most cases, both insulating and exothermic properties are needed in the sleeves, both aluminum metal and hollow aluminosilicate microspheres will be used in the sleeve. In sleeves where both insulating and exothermic properties are needed, the weight ratio of aluminum metal to hollow aluminosilicate microspheres is typically from about 1:5 to about 1:1, preferably from about 1:3 to about 1:1.5.

The hollow aluminosilicate microspheres typically have a particle size of about 3 mm. with any wall thickness. Preferred are hollow aluminosilicate microspheres having an average diameter less than 1 mm and a wall thickness of approximately 10% of the particle size. It is believed that hollow microspheres made of material other than aluminosilicate, having insulating properties, can also be used to replace or used in combination with the hollow aluminosilicate microspheres.

The weight percent of alumina to silica (as $SiO_2$) in the hollow aluminosilicate microspheres can vary over wide ranges depending on the application, for instance from 25:75 to 75:25, typically 33:67 to 50:50, where said weight percent is based upon the total weight of the hollow microspheres. It is known from the literature that hollow aluminosilicate microspheres having a higher alumina content are better for making sleeves used in pouring metals such as iron and steel which have casting temperatures of 1300° C. to 1700° C. because hollow aluminosilicate microspheres having more alumina have higher melting points. Thus, sleeves made with these hollow aluminosilicate microspheres will not degrade as easily at higher temperatures.

Refractories, although not necessarily preferred in terms of performance because of their higher densities and high thermal conductivities, may be used in the sleeve composition to impart higher melting points to the sleeve mixture, so the sleeve will not degrade when it comes into contact with the molten metal during the casting process. Examples of such refractories include silica, magnesia, alumina, olivine, chromite, aluminosilicate, and silicon carbide among others. These refractories are preferably used in amounts less than 50 weight percent based upon the weight of the sleeve composition, more preferably less than 25 weight percent based upon the weight of the sleeve composition. When alumina is used as a refractory, it is used in amounts of less than 50% weight percent based upon the weight of the sleeve composition, more preferably less than 10% weight percent based upon the weight of the sleeve composition.

The density of the sleeve composition typically ranges from about 0.1 g/cc to about 0.9 g/cc, more typically from about 0.2 g/cc to about 0.8 g/cc. For exothermic sleeves, the density of the sleeve composition typically ranges from about 0.3 g/cc to about 0.9 g/cc, more typically from about 0.5 g/cc to about 0.8 g/cc. For insulating sleeves, the density of the sleeve composition typically ranges from about 0.1 g/cc to about 0.7 g/cc, more typically from about 0.3 g/cc to about 0.6 g/cc.

In addition, the sleeve composition may contain different fillers and additives, such as cryolite ($Na_3AlF_6$), potassium aluminum tetrafluoride, and/or potassium aluminum hexafluoride.

The sleeve compositions are mixed with chemical binders to form a sleeve mix. Any inorganic or organic foundry binder, that sufficiently holds the sleeve mix together in the shape of a sleeve and polymerizes in the presence of a curing catalyst, will work. Examples of such binders include inorganic binders such as sodium silicate binders cured with carbon dioxide (see U.S. Pat. No. 4,985,489 which is hereby incorporated into this disclosure by reference), and organic binders such as phenolic resins, phenolic urethane binders, furan binders, alkaline phenolic resole binders (see U.S. Pat. No. 4,750,716, which is hereby incorporated by reference), and epoxy-acrylic binders among others. Preferred binders include epoxy-acrylic binders sold by Ashland Inc. under the ISOSET® trademark. The epoxy-acrylic binders, cured with sulfur dioxide in the presence of an oxidizing agent, are described in U.S. Pat. No. 4,526,219, which is hereby incorporated into this disclosure by reference. Most preferred as the binder are amine curable phenolic urethane binders, as are described in U.S. Pat. Nos. 3,485,497, 3,409,579, and 3,676,3923, which are hereby incorporated into this disclosure by reference. These binders are based on a two-part system, one part being a phenolic resin component and the other part being a polyisocyanate component.

The amount of binder needed is an effective amount to maintain the shape of the sleeve and allow for effective curing, i.e. which will produce a sleeve which can be handled or self-supported after curing. An effective amount of binder is greater than about 4 weight percent, based upon the weight of the sleeve composition. Preferably, the amount of binder ranges from about 5 weight percent to about 15 weight percent, more preferably from about 6 weight percent to about 12 weight percent.

Curing the sleeve by the no-bake process takes place by mixing a liquid curing catalyst with the sleeve mix, shaping the sleeve mix containing the catalyst, and allowing the sleeve shape to cure, typically at ambient temperature without the addition of heat. The preferred liquid curing catalyst is a tertiary amine and the preferred no-bake curing process is described in U.S. Pat. No. 3,485,797, which is hereby incorporated by reference into this disclosure. Specific examples of such liquid curing catalysts include 4-alkyl pyridines wherein the alkyl group has from one to four carbon atoms, isoquinoline, arylpyridines such as phenyl pyridine, pyridine, acridine, 2-methoxypyridine, pyridazine, 3-chloro pyridine, quinoline, N-methyl imidazole, N-ethyl imidazole, 4,4'-dipyridine, 4-phenylpropylpyridine, 1-methylbenzimidazole, and 1,4-thiazine.

Curing the sleeve by the cold-box process takes place by blowing or ramming the sleeve mix into a pattern and contacting the sleeve with a vaporous or gaseous catalyst. Various vapor or vapor/gas mixtures or gases such as tertiary amines, carbon dioxide, methyl formate, and sulfur dioxide can be used depending on the chemical binder chosen. Those skilled in the art will know which gaseous curing agent is appropriate for the binder used. For example, an amine vapor/gas mixture is used with phenolic-urethane resins. Sulfur dioxide (in conjunction with an oxidizing agent) is used with an epoxy-acrylic resin. Carbon dioxide (see U.S. Pat. No. 4,985,489, which is hereby incorporated by reference) or methyl esters (see U.S. Pat. No. 4,750,716 which is hereby incorporated into this disclosure by reference) are used with alkaline phenolic resole resins.

Preferably sleeves are prepared by a cold-box process with a phenolic urethane binder by passing a tertiary amine gas, such a triethylamine, through the molded sleeve mix in the manner as described in U.S. Pat. No. 3,409,579; with an epoxy-acrylic binder cured with sulfur dioxide by a free radical mechanism in the presence of an oxidizing agent as described in U.S. Pat. No. 4,526,219; or with an epoxy-acrylic-polyisocyanate binder cured with a tertiary amine gas and by a free radical mechanism as described in U.S. Pat. No. 5,880,175, which is hereby incorporated by reference.. Typical gassing times are from 0.5 to 3.0 seconds, preferably from 0.5 to 2.0 seconds. Purge times are from 1.0 to 60 seconds, preferably from 1.0 to 10 seconds.

EXAMPLES

The Examples are to illustrate how the invention is carried out, but should not be construed to limit its application. All parts are by weight and all percentages are weight percentages based upon the weight of the sleeve composition unless otherwise specified.

Insulating sleeves were prepared using cold-box technology with a phenolic-urethane binder (ISOCURE® Part I and Part II binder) by mixing the sleeve compositions consisting of pH stabilized microspheres and 8.8 weight percent binder based on the weight of the sleeve mix in a Hobart N-50 mixer for about 4 minutes. The sleeve compositions containing the pH stabilized microspheres were then shaped into test cores and cured with triethylamine catalyst using conventional cold-box technology. The sleeves were then tested for casting performance in both steel and ductile iron in the Melt Lab. Insertable style 2"×3" (diameter/height) risers were used on top of a 3" cube casting for steel and on top of an impeller test casting for ductile iron.

The stabilized hollow aluminum microspheres used in the Examples were prepared as follows:

SG microspheres dispersed in water. Then 0.5% HCl acid was added slowly with agitation until the pH of the slurry is in the range 2.5–3.5. Then the spheres were decanted, dried, and tested for pH after heating for 30 minutes at several elevated temperatures. Table I shows the pH of the microspheres before and after treatment.

The stabilized hollow aluminosilicate microspheres, having an alumina content of less than 38 weight percent alumina, were tested for stability at different temperatures. The results are summarized in Table I below.

TABLE I pH of Microspheres Before and After Treatment

| Temperature (° C.) | pH of SG Microspheres | pH of SG treated with HCL |
|---|---|---|
| 25 | 8.3 | 6.6 |
| 500 | 8.3 | 6.9 |
| 700 | 11.6 | 6.8 |
| 900 | 11.5 | 6.9 |
| 1200 | 11.4 | 7.0 |

The data in Table I indicate that the pH of the SG microspheres treated with HCl (pH stabilized microspheres) remained essentially unchanged when exposed to increased temperatures. This suggests that cations will not be released when the sleeves containing the stabilized hollow aluminosilicate microspheres having an alumina content of less than 38 weight percent alumina are exposed to temperatures greater than 700° C.

Several mixes of sand and hollow aluminosilicate microspheres (standard SG and pH stabilized microspheres were prepared and tested for pH. The compositions are set forth in the Table II.

Table II

Effect of Microspheres on pH of Silica Sand (25% slurry).

| Amount of Microspheres | pH of Sand/SG Microspheres | pH of Sand/SG treated with HCl |
|---|---|---|
| 0% | 6.9 | 6.9 |
| 1% | 8.5 | 6.7 |
| 2% | 9.2 | 6.9 |
| 5% | 10.2 | 6.9 |

The data in Table II indicate that the various mixes of sand and pH stabilized microspheres have a stable pH, even as the amount of pH stabilized microspheres in the mix increases, while the pH of the mixtures of sand and standard SG microspheres increase as the amount of SG microspheres in the mix increase. Maintaining a stable pH is important because it is easier to rebond such sand after reclamation, particularly where the sand is reclaimed at higher temperatures, i.e. temperatures greater than 700° C., which promote the release of cations that contaminate the sand.

The pH stabilized microspheres that were heated to 700° C. were added to silica sand and mixed with 2% by weight of PEPSET® 1670/2670 no-bake binder. Test cores were prepared with the sand mixes. Work times and strip times were determined for each mix, and are shown in Table III.

TABLE III

The Effect of Microspheres on Work Time/Strip Time Using a PEPSET No-Bake Binder

| Example | Work time (min) | Strip Time (min) |
|---|---|---|
| SS[2] | 10 | 13 |
| SS + 2% SG | 6 | 9 |
| SS + 2% SG treated with HCl | 12 | 16 |

[2]SS =silica sand.

Table III shows that the SG microspheres shorten the work time and strip time of cores made with PEPSET 1670/2670 no-bake binder. On the other hand, the pH stabilized SG microspheres treated with acid have little effect on speed of the reaction.

Table IV shows the affect of the different microspheres on the tensile strengths of test cores made with a no-bake foundry mix made by mixing sand, an organic binder, and a liquid curing catalyst. The test cores made with SG microspheres show a significant reduction in the tensile strength, especially the 24 hour strength. On the other hand, the tensile strengths of the test cores made with the pH stabilized microspheres did not decrease significantly.

TABLE IV

The Effect of Microspheres on Tensile Strengths of Test Cores Using a PEPSET No-Bake Binder

| | Tensile Strengths (psi) | | | |
|---|---|---|---|---|
| Example | 30 min | 1 hr | 24 hr | 24 hrs + 90% RH |
| SS | 67 | 104 | 267 | 63 |
| SS + 2% SG | 37 | 51 | 91 | 48 |
| SS + 2% SG treated with HCl | 67 | 111 | 208 | 63 |

What is claimed is:

1. A sleeve mix comprising:

(A) a sleeve composition comprising stabilized hollow aluminosilicate microspheres having an alumina content of less than 38 weight percent alumina based upon the weight of the microspheres, and (B) an effective amount of an organic polymeric binder.

2. The sleeve mix of claim 1 wherein the amount of stabilized aluminosilicate microspheres in the sleeve composition is from 25 weight percent to 100 weight percent based upon the weight of the sleeve composition.

3. The sleeve mix of claim 2 wherein said sleeve mix is an exothermic sleeve mix and further comprises an oxidizable metal and an oxidizing agent capable of generating an exothermic reaction.

4. The sleeve mix of claim 3 wherein the oxidizable metal is aluminum metal.

5. The sleeve mix of claim 2 wherein said sleeve mix is an insulating sleeve mix and further comprises hollow aluminosilicate microspheres that are not stabilized.

6. The sleeve mix of claim 5 wherein the amount of hollow aluminosilicate microspheres in the sleeve composition is from 80 weight percent to 95 weight percent based upon the weight of (A) and (B).

7. The sleeve mix of claim 6 wherein the binder is selected from the group consisting of phenolic urethane binders and epoxy-acrylic binders.

8. The sleeve mix of claim 6 wherein the sleeve composition contains a refractory.

9. The sleeve mix of claim 8 wherein the binder level is from about 4 weight percent to about 12 weight percent based upon the weight of the sleeve composition.

* * * * *